United States Patent [19]

Jensen

[11] 3,983,626

[45] Oct. 5, 1976

[54] ELECTRIC DRY SHAVER

[75] Inventor: Lionel R. Jensen, Glen Ellyn, Ill.

[73] Assignee: Sunbeam Corporation, Chicago, Ill.

[22] Filed: Jan. 14, 1974

[21] Appl. No.: 432,964

[52] U.S. Cl. ..... 30/34.2; 30/43.92

[51] Int. Cl.[2] ..... B26B 19/42; B26B 19/04

[58] Field of Search ..... 30/34.2, 90, 179, 200, 30/201, 233.5, 43.92

[56] References Cited

UNITED STATES PATENTS

| | | | |
|---|---|---|---|
| 2,204,146 | 6/1940 | Muros | 30/43.92 |
| 2,395,495 | 2/1946 | Murphy | 30/34.2 |
| 3,290,775 | 12/1966 | Tolmie | 30/34.2 |
| 3,552,010 | 1/1971 | Locke | 30/43.92 |
| 3,673,684 | 7/1972 | Muntz | 30/34.2 |

*Primary Examiner*—Gary L. Smith

*Attorney, Agent, or Firm*—George R. Clark; Neil M. Rose; John S. Pacocha

[57] ABSTRACT

An electric shaver for shaving the legs and underarms of women wherein separate head assemblies are provided for leg shaving and for underarm shaving, the head assembly for leg shaving having a pair of spaced parallel heads, the combs of which are relatively thin for close shaving. The underarm head assembly having a single shaving head provided with a comb which is relatively thick to prevent irritation during underarm shaving and having adjacent thereto an elongated guard which is similar in overall dimensions to one of the shaving heads but has a plurality of spaced ribs which engage the skin and smooth it out in advance of the shaving operation.

2 Claims, 9 Drawing Figures

ELECTRIC DRY SHAVER

BACKGROUND OF THE INVENTION

The invention relates to electric shavers and more particularly to electric shavers designed specifically for use by women in shaving their legs and underarm areas.

During the last 20 years there has been a great increase in the use of electric shavers by women for use in shaving their legs and underarm areas. Many of these shavers which have been placed on the market are substantially the same as the shavers which are also offered for sale for shaving men's facial hair. There is a considerable difference in the problems involved and the requirements associated with women's shavers as compared to those designed for men. The hair found on the legs and underarms of women is finer and less stiff than the facial hair with which men are concerned. In addition, the skin of women, particularly in the underarm area, tends to be much more tender and more easily irritated than the skin on the face of a man. In addition, women have less necessity for a close shave than does a man.

Not only are the requirements of a shaver for a women quite different than those associated with a men's shaver, but, in addition, there is considerable difference between the requirements of a women's shaver in shaving legs as compared to the underarm area. The skin under the arm is much more subject to irritation than is the skin on the legs and, in addition, a closer shave is required on the legs than on the underarm area. Prior art attempts at producing a shaver which would operate satisfactorily for both leg and underarm shaving have been relatively unsuccessful. One prior art lady's shaver is shown in Spohr U.S. Pat. No. 3,432,652. Although the shaving head disclosed in the subject Spohr patent was satisfactory, it was difficult to manufacture the head in such a way that it would give an acceptably close shave on the legs while avoiding irritation in the underarm area.

There are many examples in the prior art of shavers which have been provided with guards to either lessen irritation or prevent the shaver from cutting too close. Examples of such guards are shown in Tolmie U.S. Pat. No. 3,290,775, MacDonald U.S. Pat. No. 2,864,162, Denocenzo U.S. Pat. No. 2,539,011, and Dalkowitz U.S. Pat. No. 2,228,258. These patents disclose guards which were essentially used with men's shavers to improve the shaving characteristics or to facilitate trimming of hair as contrasted with shaving.

BRIEF DESCRIPTION OF THE INVENTION

The instant invention involves a shaver for women which has two separate and distinct shaving assemblies which are alternatively useable to shave legs or underarms. The shaving head assembly for shaving legs involves the use of two spaced heads which are provided with relatively thin combs so as to achieve a close shave. The head assembly designed for shaving in the underarm area includes a single shaving head having a relatively thick and protected comb which minimizes or eliminates skin irritation in underarm shaving. In addition, extending parallel to the shaving head there is provided a guard member which is designed to smooth our or level the skin in advance of the shaving head and which includes a plurality of spaced ribs which reduce or eliminate the friction associated with the guard member and permit the shaving head assembly to be moved across the skin rapidly. The shaver includes a pair of drive arms which, when operating the shaving assembly for leg shaving, drive the two shaving heads in an out of phase manner, i.e., with the cutters moving in opposite direction. With the underarm shaving assembly in position on the shaver, one of the drive arms of the shaver drives a shaving head in the normal fashion while the other drive arm engages rubber restraining members in the guard member to lessen the noise and eliminate the power loss which would otherwise be associated with that drive arm.

It is an object of the present invention to provide an improved shaver for women having two shaving heads, one adapted for leg shaving and the other for underarm shaving.

It is another object of the present invention to provide an improved lady's shaver having a head specifically designed for underarm shaving and having a single shaving head mounted on an assembly which also includes a ribbed guard member.

Another object of the present invention is to provide an improved shaver for women having a shaving assembly for leg shaving wherein the combs are thin for close shaving and having a head for underarms in which a single shaving head has a thicker comb to minimize skin irritation and has a ribbed guard extending the length of the shaving head.

Further objects and advantages of the present invention will become apparent as the following description proceeds and the features of novelty which characterize the invention will be pointed out with more particularity in the claims annexed to and forming a part of this specification.

DESCRIPTION OF THE DRAWINGS

FIG. 3 shows the entire shaver;

Figure 1:
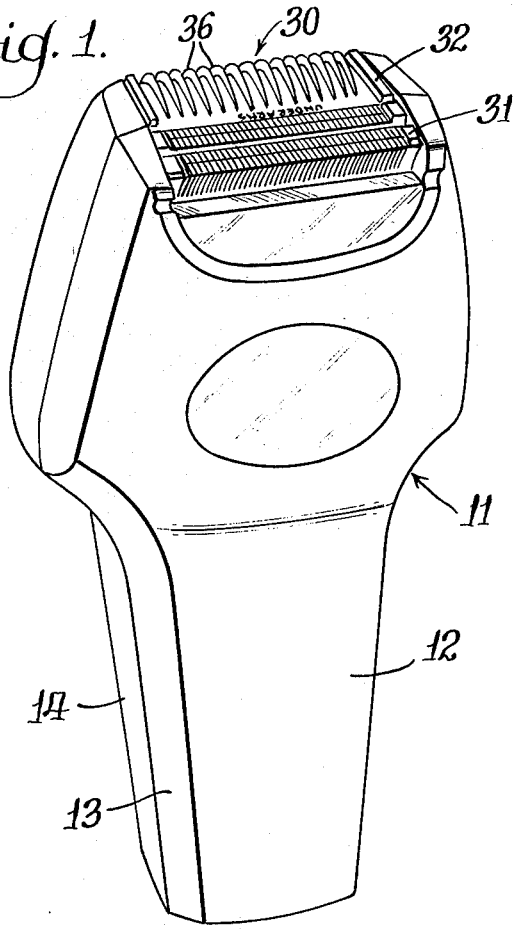
FIG. 1 is a perspective view of an electric shaver embodying the invention.

Referring to the drawings, there is shown in FIG. 1 a shaver designated generally by the reference numeral 11. The shaver 11 includes a housing 12 which is made up of a front housing half 13 and a rear housing half 14 which are secured together by screws 15 to form an enclosure within which motor 17 is mounted. The details of the motor are disclosed in the above cited Spohr U.S. Pat. No. 3,432,652. It should be noted that the motor 17 includes a field winding 18, a laminated core 19 and a pair of oppositely oscillating armatures 20 and 21. Associated with each of the armatures 20 and 21 are drive levers 22 and 23.

The upper part of the housing 12 is formed with a recess 25 within which a shaving assembly 27 is retained. The shaving assembly 27 may take the form of the shaving assembly disclosed in Spohr U.S. Pat. No. 3,432,642 as far as the head for shaving the legs is concerned.

Figure 2:
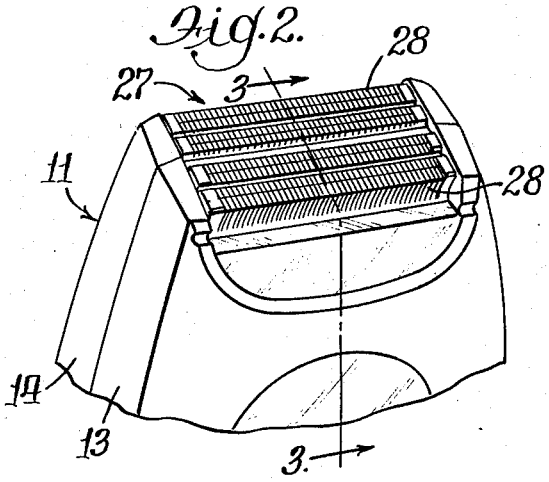
FIG. 2 is a fragmentary perspective view similar to FIG. 1 but showing the shaver of FIG. 1 with the leg shaving head assembly rather than the underarm shaving assembly.
Figure 3:
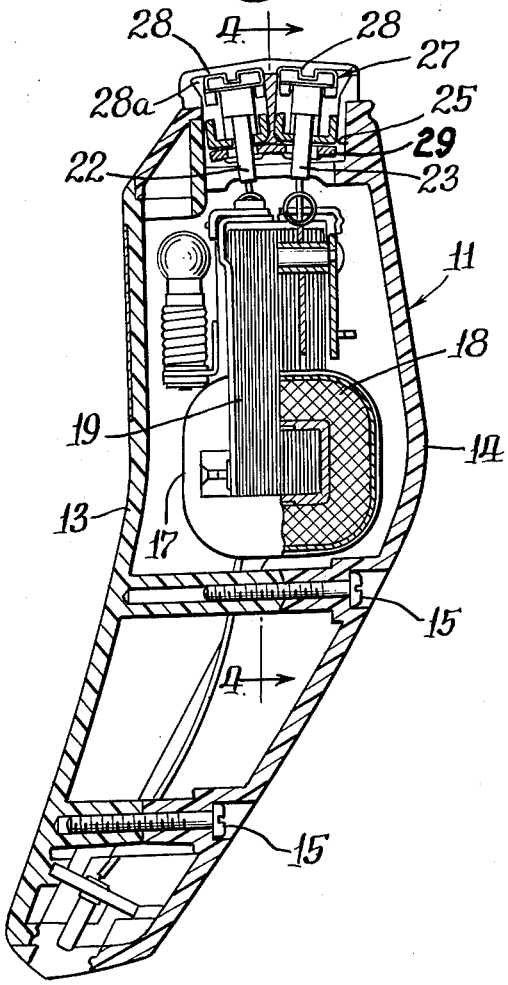
FIG. 3 is a sectional view taken substantially along line 3—3 of FIG. 2, assuming FIG. 2 showed the complete shaver.
Figure 4:
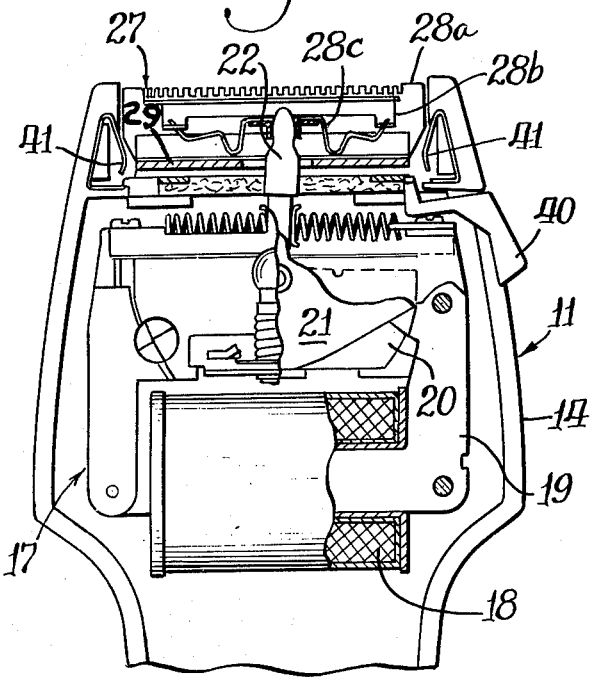
FIG. 4 is a sectional view taken substantially on line 4—4 of FIG. 3, assuming

As was noted above, a shaving head which is acceptable as providing a close shave in shaving hair on the legs is generally unsuitable for shaving the underarm area since there would tend to be skin irritation. In accordance with the present invention, this problem has been solved by providing a separate head for shaving underarms as compared to shaving legs. The shaving head assembly 27 as shown in FIGS. 2, 3 and 4 designed for shaving the legs includes a pair of spaced heads 28 which are identical in construction. Each of the heads includes a slotted comb 28*a* and a cutter 28*b* which is biased into engagement with the comb by a spring 28*c*. The cutters 28*b* are engaged by the drive arms 22 and 23 and are driven in a counter reciprocating manner. The shaving heads 28 of the assembly 27 are mounted on an assembly plate 29 by means of screws which are not shown. The details of the assembly 27 are disclosed completely in the above mentioned Spohr U.S. Pat. No. 3,432,652.

Figure 5:
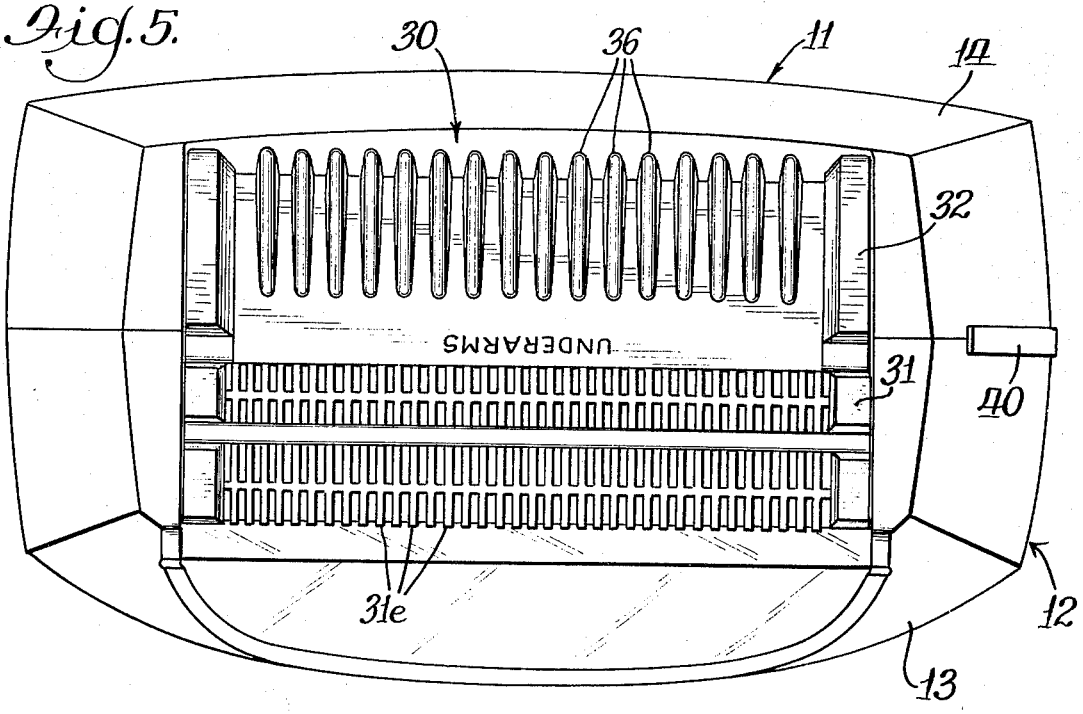
FIG. 5 is an enlarged top plan view of the shaver of FIG. 1.
Figure 6:
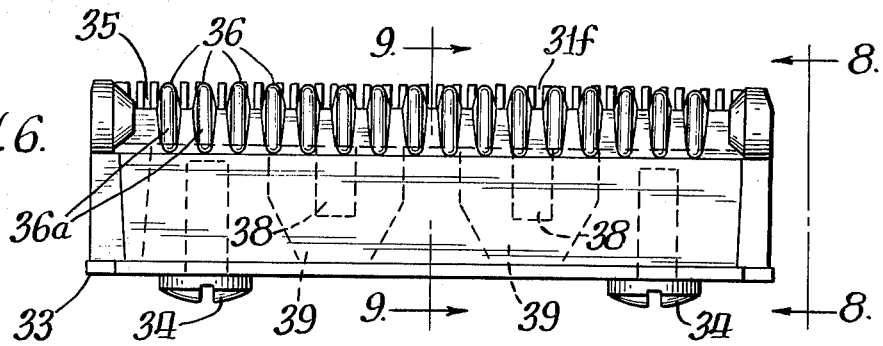
FIG. 6 is a side elevational view of the underarm shaving head assembly.
Figure 7:
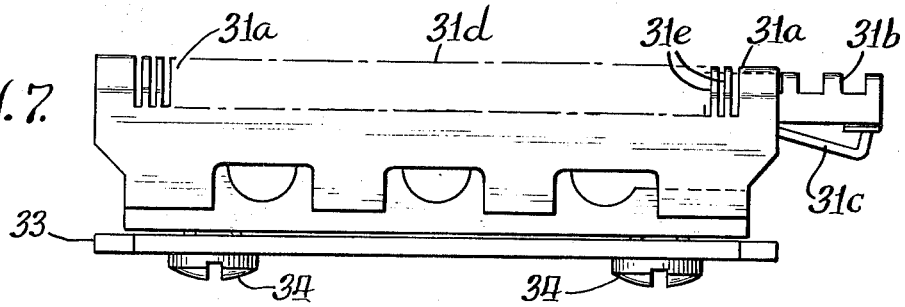
FIG. 7 is a side elevational view of the shaving head of FIG. 6 as viewed from the rear as shown in FIG. 6.
Figure 8:
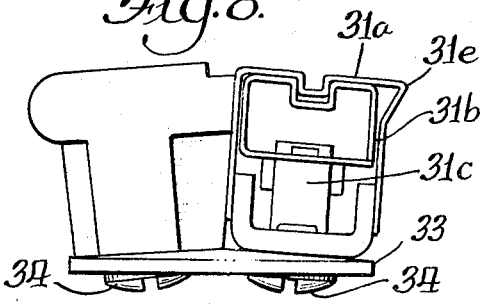
FIG. 8 is an end elevational view taken substantially on line 8—8 of FIG. 6.
Figure 9:
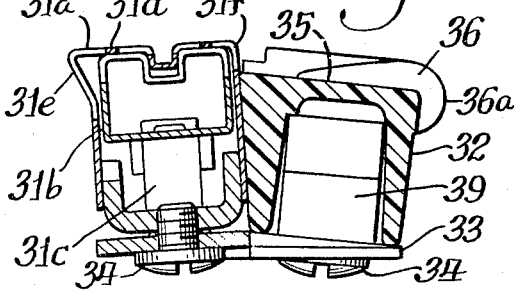
FIG. 9 is a sectional view taken substantially on line 9—9 of FIG. 6.

The shaver 11 is also provided with an underarm shaving assembly 30 as is shown in FIGS. 1, 5 and 9. The shaving head assembly 30 includes a shaving head 31 and a guard member 32. The shaving head 31 is identical to the shaving head 28 adapted for leg shaving except for the fact that the comb in the shaving head 31 is thicker than the comb 28*a* in order to minimize the risk of skin irritation. The shaving head 31 includes a comb 31*a*, a reciprocating cutter 31*b* and a biasing spring 31*c*. In considering the shaving head 31 as best shown in FIGS. 7, 8 and 9, it should be noted that the head 31 has an outwardly facing skin engaging surface 31*d* which is provided with rows of slots which are adapted to receive the hair to be cut. Although the comb 31 is generally U-shaped and conforms quite closely to the contour of the cutter 31*b*, it should be noted in FIGS. 8 and 9 that the comb teeth are formed with outwardly extending portions 31*e* which tend to guard against the skin entering the comb slots and getting cut or irritated by the reciprocating cutter 31*b*. These portions 31*e* are effectively extensions on the means defining the comb slots and essentially prevent the skin from entering the area of the slots where the cutter 31*b* is reciprocating. The portions 31*e* of the shaving head 31 are formed only on the outside edge of the head. The other side of the shaving head 31 which is not protected by the portions 31*e* is guarded or protected by the guard 32.

The guard or guard member 32 is an inverted channel shaped box-like member which has the same general outside dimensions as the heads 28 or 31. By having the shaving head assemblies 27 and 30 with the same general overall dimensions, they are both receivable in the recess 25 and may be readily substituted one for the other. In addition, by having the heads 31 substantially the same as the head 32 except for the thickness of the comb portion defining the slots, the manufacture of the shaver is simplified considerably since there is only a single head to be tooled and manufactured with only a different grinding operation required to produce the thinner comb for head 31.

The guard member 32 and the shaving head 31 are mounted on an assembly plate 33 by means of screws 34. The guard member 32 has an outwardly facing surface 35 which is slightly below and substantially parallel to the skin engaging surface 31*d* of the shaving head 31. The surface 35 extends up to the inner wall of the comb 31*a* which, as is shown in FIG. 9, is slotted at 31*f* down the inner sidewall of the comb 31*a* to a point substantially level with the surface 35.

In order to reduce the friction of the guard member 32 passing across the skin during underarm shaving there are provided a number of ribs 36 which at their front ends are rounded as shown at 36*a* in FIG. 9. As the shaving assembly 31 moves across the skin in the underarm area with the guard member 32 in the head, the loose skin in the underarm area is smoothed and evened by the guard member 32 before engaging the shaving head 31. In addition, as was mentioned above, the comb 31*a* is made slightly thicker than the corresponding comb 28*a* of the shaving head 28. These changes or differences minimize the possibility of the shaving assembly 30 causing irritation in the underarm area.

Since only the drive lever 22 is engaged with a shaving head when the shaving assembly 30 is used, means are provided in the guard member 32 to immobilize the drive lever 23. The guard member 32 is formed with downwardly projecting molded bosses 38 on which are received molded rubber caps 39. The upper end of the drive lever 23 is received between these caps 39 and restrained against oscillation. With the armature associated with lever 23 in the restrained position, there is more power available to and delivered to the armature associated with the drive lever 22.

When the shaver 11 is being used for leg shaving, the shaving assembly 27 is placed in position as shown in FIG. 2 in the recess 25. When the leg shaving is completed, the user of the shaver depresses the head ejection lever 40 as shown in FIG. 4 thereby displacing the shaving assembly 27 out of engagement with the retaining springs 41. The shaving assembly 27 is then replaced with the shaving assembly 30 and the user proceeds to complete shaving in the underarm area. The thicker comb in the shaving head 31 and the guard member 32 eliminate or minimize the possibilities of skin irritation in spite of the different character of the skin and hair in the underarm area. Accordingly, there is provided an electric shaver which is better adapted to meet the requirements of women's shaving while at the same time eliminating the need for providing two complete new shaving heads.

While particular embodiments of the present invention have been illustrated and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. An electric shaver adapted for close shaving of legs and for shaving underarm hair comprising a shaver housing enclosing a motor and having a shaving assembly support thereon, separate alternatively usable first and second shaving assemblies each having means detachably connecting it on said assembly support for driving connection with said motor, said first shaving assembly including a base member having a pair of shaving heads mounted thereon in closely spaced parallel relation, each shaving head comprising a slotted comb with an outwardly facing skin engaging surface and a reciprocating cutter, the thickness of said combs and the size of the slots therein adapting said combs to close shaving of leg hair, said second shaving assembly including a base member supporting a single shaving head substantially identical to said pair of shaving heads on one side thereof but having a thicker comb suitable for underarm shaving, a guard member mounted on said base member in spaced parallel relation to said single shaving head, said guard member being coextensive with said single shaving head and having an outwardly facing surface which is positioned below the skin engaging surface of the slotted comb of said single shaving head, said guard member having a leading edge which is parallel to said single shaving head and at the edge of said facing surface away from said shaving head, said guard member causing skin moving toward said single shaving head across said facing surface of said guard to be flat and in substantially the same plane as the skin engaging surface of said slotted comb in said single shaving head, first and second drive means for delivering power from said motor to said pair of shaving heads, said guard member being provided with a restraining means which is engaged by said first drive means while said second drive means drives said single shaving head, said restraining means immobilizing said drive means and substantially eliminating power transfer by said first drive means.

2. A shaving assembly for use on an electric shaver comprising a generally flat rectangular support plate, a shaving head having an elongated box-like comb and a cutter mounted for reciprocation in said comb, said comb having a base secured to said support plate, an outer wall of said comb opposite to said base being flat and provided with slots arranged in two rows which rows extend the length of the comb with shearing teeth defined by said slots extending transverse to the length of the comb, said comb having sidewalls with said slots extending into said sidewalls to form teeth thereon, a guard member having similar outside dimensions as said shaving head and being mounted on said plate in parallel relation to said shaving head, spaced elongated ribs on said guard member extending parallel to said slots and being positioned on a surface of said guard member which is positioned below said outer wall of said comb with said ribs extending to a plane level with said outer wall, said ribs extending beyond the side of said guard member and being rounded at their outer ends so that when the shaving assembly traverses the skin in the direction in which the rounded ends are directed, the ribs level and smooth out the skin in advance of the shaving head, the teeth on said comb most remote from said guard member extend substantially beyond the edge of the cutter to limit entry of skin into the portion of said slots which is traverse by said cutter, said ribs on said guard member tapering downwardly to said guard member surface from said rounded ends, the outer surface of said guard member being positioned substantially level with the ends of said slots in said sidewalls to expose said slots in said sidewalls to permit entry of hair into said slots.

* * * * *